US007926988B2

(12) United States Patent
Robinson

(10) Patent No.: US 7,926,988 B2
(45) Date of Patent: Apr. 19, 2011

(54) POCKET FLASHLIGHT

(75) Inventor: Kenneth M. Robinson, Effort, PA (US)

(73) Assignee: Koehler-Bright Star LLC, Hanover Township, PA (US)

( * ) Notice: Subject to any disclaimer, the term of this patent is extended or adjusted under 35 U.S.C. 154(b) by 201 days.

(21) Appl. No.: 12/332,473

(22) Filed: Dec. 11, 2008

(65) Prior Publication Data

US 2009/0147506 A1 Jun. 11, 2009

Related U.S. Application Data

(60) Provisional application No. 61/007,171, filed on Dec. 11, 2007.

(51) Int. Cl.
*F21V 21/00* (2006.01)

(52) U.S. Cl. ..... 362/398; 362/191; 362/200; 362/202; 362/208; 362/396

(58) Field of Classification Search ..... 362/191, 362/200, 202, 208, 253, 368, 382, 396, 398
See application file for complete search history.

(56) References Cited

U.S. PATENT DOCUMENTS

2005/0047124 A1* 3/2005 Hsien ..... 362/188
* cited by examiner

*Primary Examiner* — Sandra L O Shea
*Assistant Examiner* — Meghan K Dunwiddle
(74) *Attorney, Agent, or Firm* — DLA Piper LLP (US)

(57) ABSTRACT

Flashlights are provided herein that can be removable attached to a magnetic surface. A flashlight can include a body having a bulb end and a clip end, a light source connected to the bulb end, and one or more magnets attached to the body flashlight. In one example, a flashlight includes a pocket clip attached to the clip end, and the one or more magnets can be attached to the pocket clip.

20 Claims, 5 Drawing Sheets

POCKET FLASHLIGHT

RELATED APPLICATIONS

This application claims the benefit of U.S. Provisional Application Ser. No. 61/007,171, filed on Dec. 11, 2007, currently pending, the disclosure of which is hereby incorporated by reference in its entirety.

BACKGROUND

The present technology relates to flashlights, and more particularly to handheld flashlights powered by one or more batteries.

A typical flashlight has a small incandescent light bulb or light emitting diode (LED) that is powered by one or more electric batteries. A parabolic reflector can be utilized to reflect light outwardly in a beam. The components are mounted in a housing that contains the necessary electric circuit, and an electric switch is provided to allow a user to turn the flashlight on and off. The housing typically provides ease of handling, a means of access to the batteries for replacement, and a clear covering over the light bulb.

Flashlights are commonly made in a variety of sizes. Most commonly, flashlights are sized to be carried in one hand, whether by gripping the housing of the flashlight itself, or by gripping a handle on the flashlight. Some flashlights are small enough to fit in a pocket, such as a shirt pocket. Such flashlights are sometimes referred to as being penlights.

BRIEF SUMMARY

The present technology relates to small flashlights, such as the type of flashlight commonly referred to as being a pocket flashlight or a penlight.

In one aspect, a flashlight is provided that includes a body having a bulb end and a clip end, a light source connected to the bulb end, and one or more magnets attached to the body flashlight.

In another aspect, a flashlight is provided that includes a body having a bulb end and a clip end, a light source connected to the bulb end, a pocket clip attached to the clip end, and one or more magnets attached to the pocket clip.

BRIEF DESCRIPTION OF SEVERAL VIEWS OF THE DRAWINGS

Specific examples have been chosen for purposes of illustration and description, and are shown in the accompanying drawings, forming a part of the specification.

DETAILED DESCRIPTION

The flashlights described herein are preferably small handheld flashlights of the type that are sometimes referred to as being pocket sized flashlights or penlights. Magnets are attached to the flashlights, which allow the flashlights to be removably attached to a magnetic surface. Various illustrative examples of such flashlights are illustrated in FIGS. 1 through 8.

Figure 1:
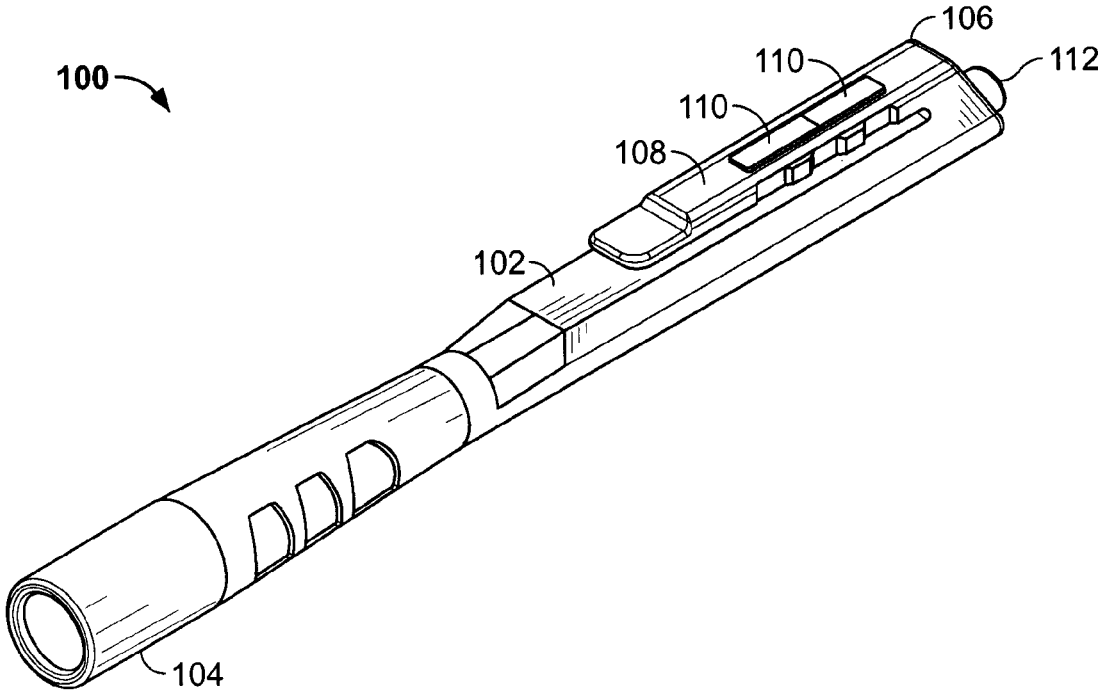
FIG. 1 is a top front perspective view of a first embodiment of a pocket flashlight.

One example of a flashlight is illustrated generally at 100 in FIG. 1. As illustrated in FIG. 1, the flashlight 100 has body 102, which includes a bulb end 104 and clip end 106. A light source (not shown), such as a light bulb or LED, is connected to the bulb end 104 of the flashlight 100, and can be located at or within the bulb end 104. The clip end 106 of the flashlight 100 has a pocket clip 108, which can be used to secure the flashlight to a pocket or to any other suitably thin object. The pocket clip 108 is preferably formed as an integral component of the body 102 of the flashlight 100, although it can be a separate piece that is preferably permanently attached to the body 102. The pocket clip 108 preferably originates at or near the tip of the clip end 106 of the flashlight 100, and extends along a portion of the length of the flashlight. The pocket clip 108 can be any suitable length, and is preferably less than half the total length of the flashlight 100, or less than one third of the total length of the flashlight.

One or more magnets are attached to the flashlight 100. As illustrated in FIG. 1, two magnets 110 are secured or attached to the pocket clip 108. In particular, magnets 110 are positioned immediately adjacent to one another on the top outer surface of the pocket clip 108. The magnets 110 can be secured or attached to the pocket clip 108 in any suitable manner, including, for example, being attached by an adhesive. Additionally, the magnets 110 can be secured to any outer surface of the pocket clip 108, or can be secured within the pocket clip 108, such as, for example, being embedded or enclosed within the pocket clip.

In alternative examples, the pocket clip 108 of the flashlight 100 can include one or more magnets, or can include two or more magnets. Flashlight 100 can have, for example, one magnet, two magnets, three magnets, or greater than three magnets. Magnets are preferably smaller in length than the pocket clip, although they can have a total length that is equal to or substantially equal to the length of the pocket clip. Magnets can have a width that is smaller than the width of the pocket clip. Magnets can also have a width equal to or substantially similar to the width of the pocket clip. In embodiments having more than one magnet, the magnets can be positioned at separate locations on the flashlight, such as, for example, being spaced along the length of the pocket clip, or can be adjacent to one another.

The flashlight embodiment illustrated in FIG. 1 has a switch 112 located on the body 102 of the flashlight that can be used to turn the flashlight on and off. Specifically, switch 112 is located at the tip of the clip end 106 of the flashlight. Switch 112 can be pressed a first time using manual force to turn the flashlight 100 on, and then pressed a second time to turn the flashlight 100 off. In alternative examples, flashlights can be turned on and off in any suitable manner known in the art, including but not limited to, a pressable or slidable switch located at any suitable point along body of the flashlight, or a twistable end cap at the clip end or bulb end of the flashlight.

While the magnets 110 of the flashlights 100 are shown as being rectangular, generally rectangular, or substantially rectangular, it should be understood that magnets can have any suitable shape. For example, the one or more magnets can each have a shape that is a circle, oval, triangle, square, trapezoid, polygon, flower, star, heart, or any irregular shape. The one or more magnets can be formed from a magnetic strip or from individually formed magnets.

Figure 3:
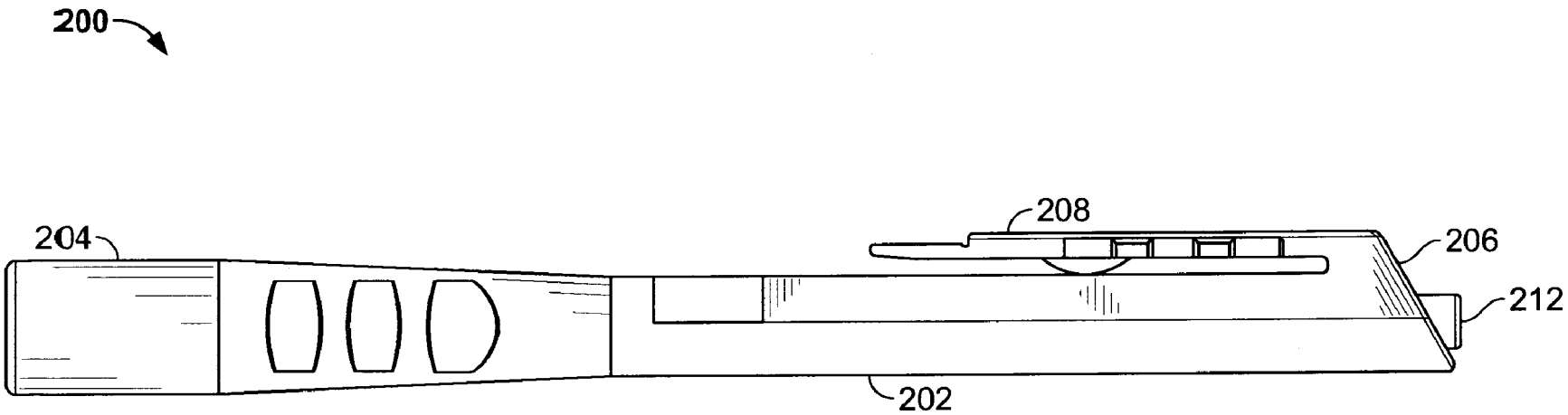
FIG. 3 is a side elevational view of the pocket flashlight of FIG. 2.
Figure 4:
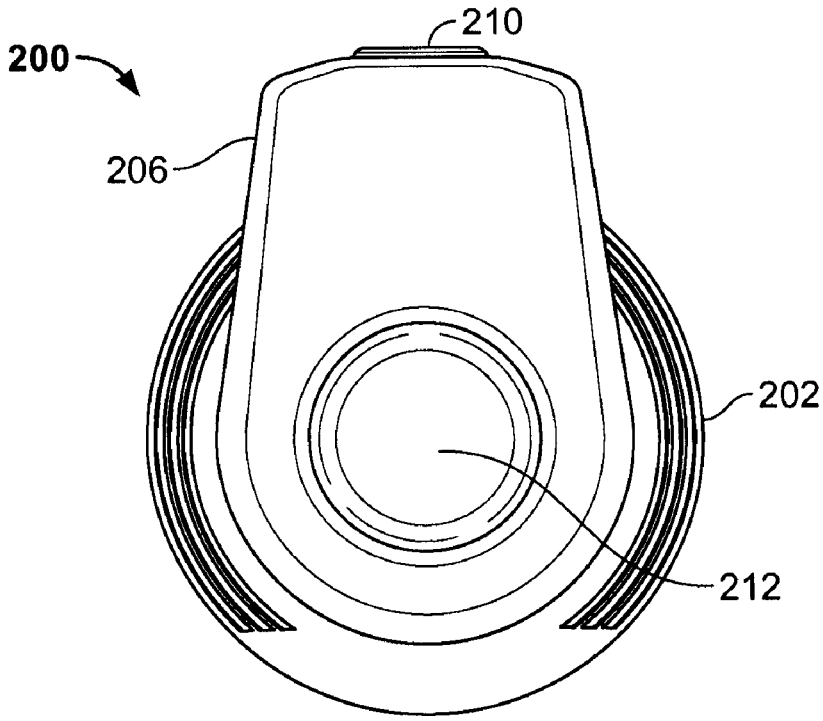
FIG. 4 is a rear end view of the pocket flashlight of FIGS. 2 and 3.
Figure 5:
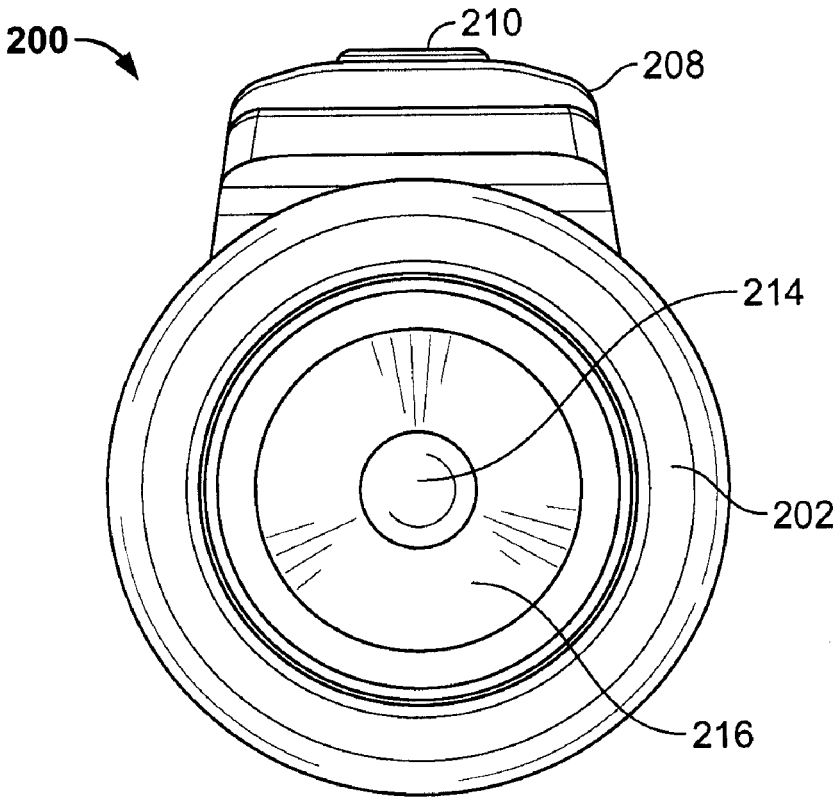
FIG. 5 is a front end view of the pocket flashlight of FIGS. 2-4.

Another example of a flashlight is illustrated generally at 200 in FIGS. 2 through 5. As shown, flashlight 200 has body 202 that includes a bulb end 204 and a clip end 206. As shown in FIG. 5, light source 214 and parabolic reflector 216 are connected to the bulb end 204 of the body 202 of the flashlight 200. Flashlight 200 also has a pocket clip 208 attached to the clip end 206 of the body 202 of the flashlight 200, and a switch 212 located at the tip of the clip end 206.

Figure 2:
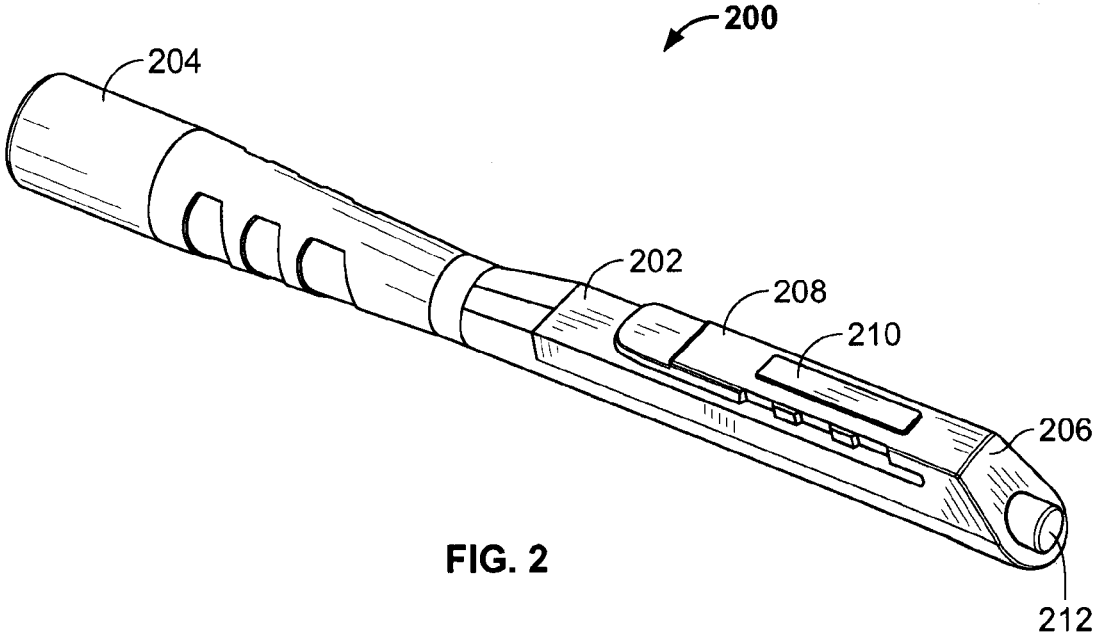
FIG. 2 is a top rear perspective view of a second embodiment of a pocket flashlight.

Flashlight 200 has a magnet 210 located on the top side of the pocket clip 208, which is integrated into the pocket clip 208. In alternative examples, flashlight 200 can have one or more magnets that can be secured to the pocket clip 208 by being embedded within the pocket clip 208. The pocket clip 208 can have a groove, a channel, a slot, or a plurality of such features into which the magnet 210 can be placed and secured to the pocket clip 208 in order to integrate the magnet 210 into the pocket clip 208. The magnet 210 can have any suitable height, width and length. As illustrated in FIGS. 4 and 5, the magnet 210 extends at least slightly above the surface of the pocket clip. The magnets can also be sized so that the top of the magnet 210 is flush with the top of the pocket clip when the magnet is placed within the pocket clip, as illustrated in FIGS. 2 and 3.

Figure 6:
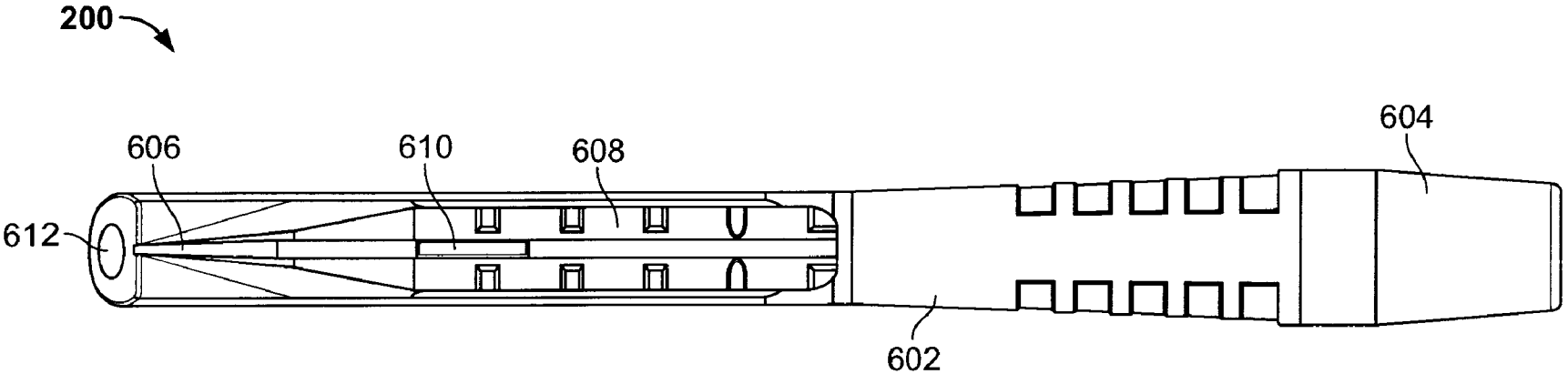
FIG. 6 is a top plan view of a third embodiment of a pocket flashlight.

A third example of a flashlight is illustrated at 600 in FIG. 6. As shown, flashlight 600 has body 602, bulb end 604, clip end 606, a pocket clip 608, and a magnet 610 on the top side of pocket clip 608. Flashlight 600 also has a switch 612 located at the tip of the clip end 606. The body 602 of flashlight 600 tapers outwardly towards bulb end 604, and bulb end 604 of flashlight 600 tapers inwardly.

Figure 7:
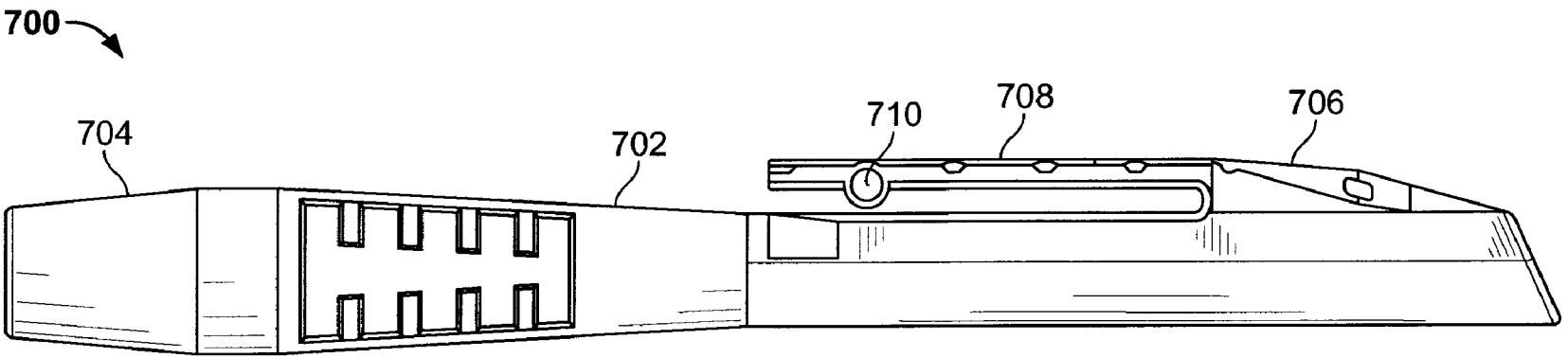
FIG. 7 is a side elevational view of a fourth embodiment of a pocket flashlight.

A fourth example of a flashlight is illustrated at 700 in FIG. 7. As shown, flashlight 700 has body 702, bulb end 704, clip end 706, and a pocket clip 708. A magnet 710 is secured within the pocket clip 708 by being enclosed by the pocket clip 708. Magnet 710 can be entirely enclosed by pocket clip 708, or, as illustrated in FIG. 7, can be at least partially enclosed by pocket clip 708. Magnet 710 is cylindrical, having a circular cross section and a length that is preferably less than or equal to the width of the pocket clip 708.

Figure 8:
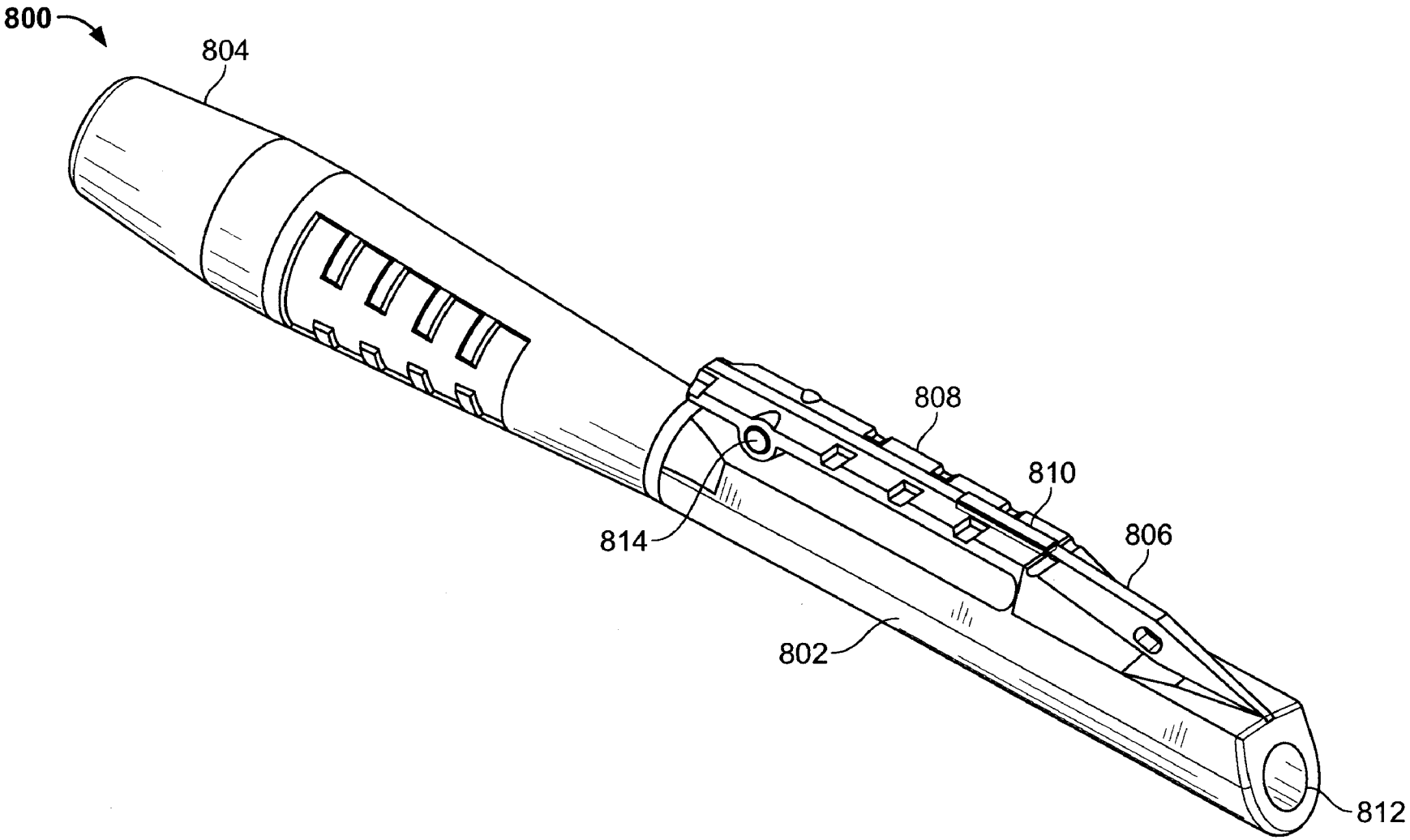
FIG. 8 is a top rear perspective view of a fifth embodiment of a pocket flashlight.

A fifth example of a flashlight is illustrated at 800 in FIG. 8. As shown, flashlight 800 has body 802, bulb end 804, clip end 806, and a pocket clip 808. A switch 812 is located at the tip of the clip end 806 of the flashlight 800. Flashlight 800 has a first magnet 810 and a second magnet 814. First magnet 810 is located on the top side of the pocket clip 808. Second magnet 814 is secured within the pocket clip 808. Second magnet 814 is cylindrical, having a circular cross section and a length that is preferably less than or equal to the width of the pocket clip 808.

Each flashlight described above has one or more magnets attached to the pocket clip of the flashlight. The one or more magnets can be attached to the top side of the pocket clip, secured within the pocket clip, or can be otherwise attached to the pocket clip. The one or more magnets attached to the pocket clip preferably allow for positioning or aiming the flashlight by attaching the flashlight to any magnetic surface, such as, for example, metals. For example, a flashlight can be placed at any desired angle on a magnetic surface, and can be adjusted by sliding the flashlight in a desired direction along the magnetic surface, or by rotating the flashlight on the magnetic surface. Additionally, the one or more magnets preferably allow a flashlight to be stored in any number of convenient locations. For example, when not clipped to a clothing pocket, the flashlight can be stored by sticking it to any magnetic surface.

From the foregoing, it will be appreciated that although specific examples have been described herein for purposes of illustration, various modifications may be made without deviating from the spirit or scope of this disclosure. It is therefore intended that the foregoing detailed description be regarded as illustrative rather than limiting, and that it be understood that it is the following claims, including all equivalents, that are intended to particularly point out and distinctly claim the claimed subject matter.

What is claimed is:

1. A flashlight that is removably attachable to a magnetic surface, the flashlight comprising:

a body having a length, a bulb end and a clip end;

a light source connected to the bulb end; and a pocket clip permanently attached to the clip end of the body, the pocket clip having one or more magnets attached to the pocket clip.

2. The flashlight of claim 1, wherein the clip has a length that is less than half of the length of the body.

3. The flashlight of claim 1, wherein the clip is an integral component of the body.

4. The flashlight of claim 1, wherein the one or more magnets are secured to an outer surface of the pocket clip.

5. The flashlight of claim 1, wherein the one or more magnets are secured within the pocket clip.

6. The flashlight of claim 1, wherein the flashlight has two or more magnets.

7. The flashlight of claim 6, wherein the two or more magnets are adjacent to each other.

8. The flashlight of claim 6, wherein the two or more magnets are positioned at separate locations on the flashlight.

9. The flashlight of claim 8, wherein the two or more magnets are spaced along the length of the pocket clip.

10. The flashlight of claim 1, further comprising a switch on the body of the flashlight that turns the flashlight on and off.

11. The flashlight of claim 1, wherein the switch is located at a tip of the clip end.

12. A flashlight that is removably attachable to a magnetic surface, the flashlight comprising:

a body having a length, a bulb end and a clip end;

a light source connected to the bulb end;

a switch located at a tip of the clip end that turns the flashlight on and off;

a pocket clip permanently attached to the clip end; and one or more magnets attached to the pocket clip.

13. The flashlight of claim 12, wherein the one or more magnets are secured to an outer surface of the pocket clip.

14. The flashlight of claim 12, wherein the one or more magnets are secured within the pocket clip.

15. The flashlight of claim 12, wherein the flashlight has two or more magnets.

16. The flashlight of claim 15, wherein the two or more magnets are adjacent to each other.

17. The flashlight of claim 15, wherein the two or more magnets are spaced along the length of the pocket clip.

18. The flashlight of claim 15, wherein the flashlight has a first magnet secured to an outer surface of the pocket clip, and a second magnet secured within the pocket clip.

19. The flashlight of claim 12, wherein the clip has a length that is less than half of the length of the body.

20. The flashlight of claim 12, wherein the clip is an integral component of the body.

* * * * *